US005229239A

United States Patent [19]

Yu

[11] Patent Number: 5,229,239

[45] Date of Patent: Jul. 20, 1993

[54] SUBSTRATE FOR ELECTROSTATOGRAPHIC DEVICE AND METHOD OF MAKING

[75] Inventor: Robert C. U. Yu, Webster, N.Y.

[73] Assignee: Xerox Corporation, Stamford, Conn.

[21] Appl. No.: 814,638

[22] Filed: Dec. 30, 1991

[51] Int. Cl.[5] ..... G03G 5/10

[52] U.S. Cl. ..... 430/67; 428/76

[58] Field of Search ..... 430/60, 64, 67; 428/76, 428/195

[56] References Cited

U.S. PATENT DOCUMENTS

| | | | |
|---|---|---|---|
| 4,026,703 | 5/1977 | Hayashi et al. | 96/1.5 |
| 4,582,772 | 4/1986 | Teuscher et al. | 430/58 |
| 4,604,303 | 8/1986 | Takakura et al. | 427/229 |
| 4,666,742 | 5/1987 | Takakura et al. | 427/229 |
| 4,702,980 | 10/1987 | Matsuura et al. | 430/63 |
| 4,747,992 | 5/1988 | Sypula et al. | 264/136 |
| 4,756,993 | 7/1988 | Kitatani et al. | 430/69 |
| 4,859,557 | 8/1989 | Detig et al. | 430/100 |
| 4,895,784 | 1/1990 | Shirai | 430/69 |
| 4,971,873 | 11/1990 | Pavlisko et al. | 430/58 |
| 5,071,723 | 12/1991 | Koyama et al. | 430/64 |
| 5,096,796 | 3/1992 | Mammino et al. | 430/67 |

*Primary Examiner*—John Goodrow
*Attorney, Agent, or Firm*—Oliff & Berridge

[57] ABSTRACT

An electrostatographic imaging member having a supporting substrate, the substrate including at least one material selected from the group consisting of polyether ether ketones, polyphenylene sulfide, polysulfones, polyether imides, polyamide imides and compounds (1), (2) and (3) as follow:

(1)

(2)

(3)

(where n represents the degree of polymerization).

35 Claims, 1 Drawing Sheet

SUBSTRATE FOR ELECTROSTATOGRAPHIC DEVICE AND METHOD OF MAKING

BACKGROUND OF THE INVENTION

This invention relates in general to electrostatography, in particular to substrates for electrophotoconductive imaging members having multiple layers.

Flexible electrostatographic belt imaging members are well known in the art. Typical electrostatographic flexible belt imaging members include, for example, photoreceptors for electrophotographic imaging systems and electroreceptors or ionographic imaging members for electrographic imaging systems. In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as a paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

U.S. Pat. No. 4,026,703 to Hayashi et al discloses a photoreceptor comprising a substrate. Included in a list of plastic films which may preferably be used is polyimide (col. 6, lines 7–20).

U.S. Pat. No. 4,971,873 to Pavlisko et al discloses photoconductor elements containing a solvent soluble polyimide binder in a barrier layer, a charge generating layer of a single-layer photoconductive element or a charge generating layer and/or a charge transport layer.

U.S. Pat. No. 4,747,992 to Sypula et al discloses a process for fabricating a belt. The belt may be used for electrostatographic imaging members as a substrate layer. The substrate layer may comprise any of a number of film forming polymers, including polycarbonates, polysulfones, polyesters, and polyvinylfluoride. Electrostatographic imaging members are also disclosed which include photogenerating layers containing photoconductive compositions and/or pigments and a resinous binder. The basis for selection from among the materials for the charge generating layer and the substrate is not disclosed.

U.S. Pat. No. 4,756,993 to Kitatani et al discloses an electrophotographic photoreceptor comprising a light-transmitting conductive support comprised of a transparent thermoplastic resin film. The resins to be used for the conductive support include polyesters, polycarbonates, polyamides, acrylic resins, polyamide- imide resins, polystyrene, polyacetals, polyolefins, etc. An electrophotographic photosensitive layer is disclosed as being an organic photoconductive layer composed of an organic photoconductive substance. Polyvinylcarbazole and its derivatives are disclosed as one such organic photoconductive substance.

U.S. Pat. No. 4,895,784 to Shirai discloses a photoconductive member comprising a drum-shaped substrate and a photoconductive layer. The substrate may be either electroconductive or dielectric. Dielectric supports include films or sheets of synthetic resins, including polyester, polyethylene, polycarbonates, cellulose acetates, polypropylene, polyvinyl chloride, polyvinylidene chloride, polystyrene, polyamide, etc. The photoconductive layer may be a vacuum deposited layer comprising an amorphous material comprising silicon atoms.

U.S. Pat. No. 4,582,772 to Teuscher et al discloses layered photoconductive imaging devices comprising an endless flexible belt substrate of an insulating material which can be selected from polycarbonates, polyurethanes, polyesters and polyamides. The thickness of the substrate is in the range of from about 50 microns to about 150 microns.

U.S. Pat. No. 4,702,980 to Matsuura et al discloses an electrostatic recording medium. The recording medium is a sheet-like product prepared from polyolefins.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors.

Modern composite imaging members have been developed which have numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, and a charge transport layer. This photoreceptor may also comprise additional layers such as an anti-curl layer and an optional overcoating layer.

Since electrophotography is a photoelectric process, a great deal of attention has been focused on electrical performance of layers. There is an ongoing need to improve the performance of photoreceptors.

SUMMARY OF THE INVENTION

Much attention has been devoted to the electrical aspects of components of photoreceptors. However, understanding of the mechanical aspects and the contribution of each mechanical component to the service life of conventional multilayered photoreceptors has been very limited. In one aspect of the present invention, there are provided substrates for photoreceptors, which substrates exhibit mechanical properties which make them especially useful for incorporation into a photoreceptor structure to enhance mechanical performance.

Examples of mechanical problems from which prior art photoreceptors, particularly photoreceptor belts, have suffered include dynamic fatigue surface cracking and seam cracking/delamination during machine cycling. Dynamic fatigue cracking in the charge transport layer causes printout defects and degradation of copy quality. Seam cracking/delamination acts like a depository site which leads to accumulation of dirt, toner and paper debris, causing cleaning blade failure, degrading print quality, and shortening the photoreceptor service life.

The present invention provides articles which overcome these and other problems by providing substrates having preferred mechanical properties. One feature of the present invention is the provision of photoreceptor belts which avoid build-up of large mechanical strain in the charge transport layer when functioning under normal machine operation conditions. In a service environment, the total mechanical strain exerted on the charge transport layer of the photoreceptor is typically the greatest among all of the photoreceptor layers; it is equal to the sum of internal strain ($S_i$), elastic strain ($S_e$), and bending strain ($S_b$). Such large mechanical strain leads to dynamic fatigue cracking in the charge transport layer as well as seam cracking/delamination of the photoreceptor belt during machine cycling.

The build-up of internal strain ($S_i$) in the charge transport layer is caused by thermal contraction mismatch between the charge transport layer and the substrate which often arises during the processes of charge transport layer solution coating, heating/drying and cooling of the resulting photoreceptor device. The build-up of the internal strain in the charge transport layer is calculated using the following equation:

$$S_i = \Delta t_1 (E_1 - E_s) \quad (1)$$

where $\Delta t_1$ is the difference between ambient temperature and the glass transition temperature of the charge transport layer, $E_1$ is the thermal contraction coefficient of the charge transfer layer, and $E_s$ is the thermal contraction coefficient of the substrate. Since the value of $\Delta t_1$ is typically high (when the photoreceptor is made by a solution coating process involving heating/drying and cooling steps) coupled with a large thermal contraction mismatch between the charge transport layer and the substrate, the contribution by both factors to internal strain build-up becomes a substantial value.

Elastic strain, $S_e$, caused by the instantaneous elastic response to the applied tension on the photoreceptor, is calculated as follows:

$$S_e = (F/A)/M \quad (2)$$

where F is the tension force applied to the photoreceptor, A is the cross-sectional area of the photoreceptor, and M is the Young's modulus of the photoreceptor.

Bending strain $S_b$ is induced at the segment of a photoreceptor when cycled or flexed over a module roller. It is calculated as follows:

$$S_b = t/(D+t) \quad (3)$$

where t is the overall thickness of the photoreceptor and D is the diameter of the roller over which the photoreceptor bends.

Another key mechanical problem associated with a photoreceptor is the development of permanent set. Photoreceptor set (defined as the permanent polymer deformation due to viscous molecular flow of the polymeric material to conform to the curvature of a roller, in particular, a small 19 mm roller, over which the photoreceptor is parked during machine idling) causes print-out defect in the area of set.

Other problems of prior art photoreceptors which are addressed by the present invention include problems caused by: (1) heat, e.g., photoreceptor dimensional instability due to substrate heat shrinkage during fabrication processes, and (2) susceptibility of photoreceptor to tearing due to the ease of substrate tear propagation.

In accordance with one aspect of the present invention, there is provided a substrate for an electrostatographic imaging member, the substrate comprising at least one material selected from the group consisting of film polyether ether ketones, polyphenylene sulfide, polysulfones, polyether imides and polyamide imides.

In accordance with another aspect of the present invention, there is provided a substrate for an electrostatographic imaging member, the substrate comprising at least one material selected from the group consisting of film-forming thermoplastic resins (1), (2) and (3) as follow:

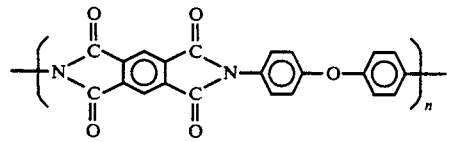

(1)

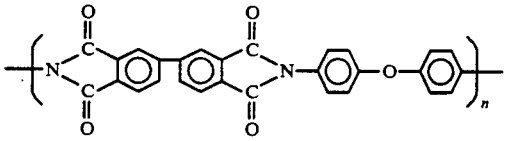

(2)

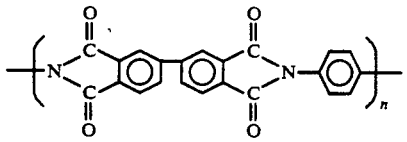

(3)

where n represents the degree of polymerization.

BRIEF DESCRIPTION OF THE DRAWING

A more complete understanding of the present invention can be obtained by reference to the accompanying FIG. 1, which is a cross-sectional view of a multilayered photoreceptor according to the invention.

DESCRIPTION OF PREFERRED EMBODIMENTS

Figure 1:
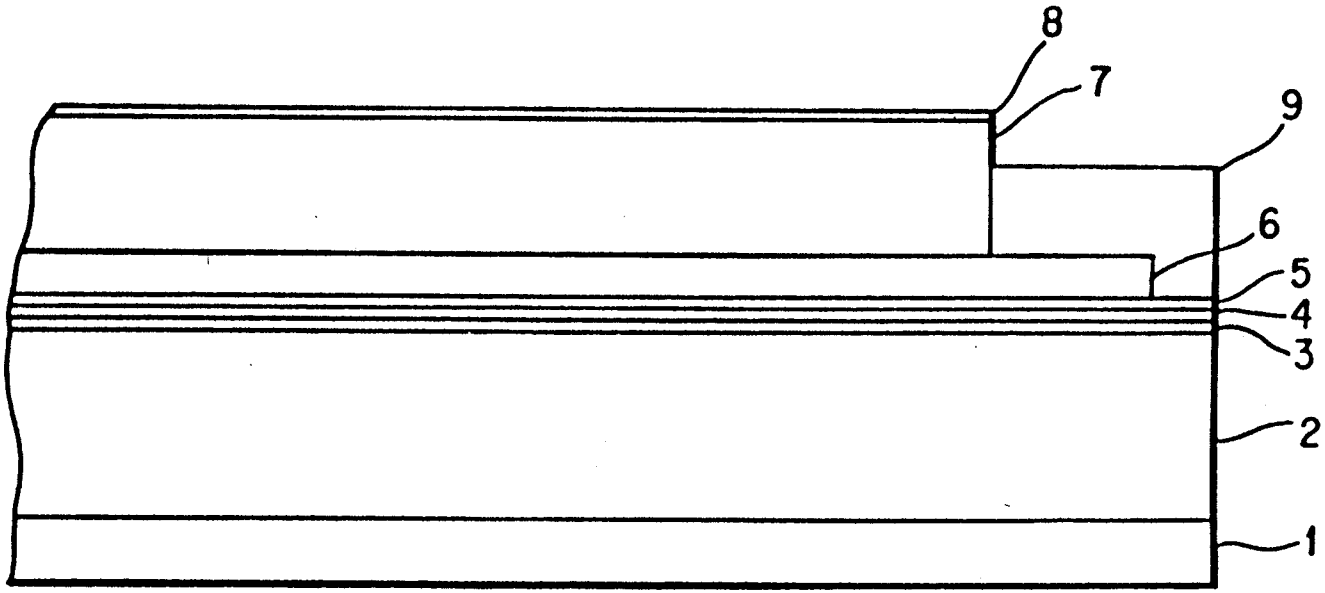

For a better understanding of the preferred embodiments of the invention, reference will be made to a particular electrophotographic imaging member. Referring to FIG. 1, there is shown an electrophotographic imaging member having an anti-curl backing layer 1, a substrate 2, an electrically conductive ground plane 3, a hole blocking layer 4, an adhesive layer 5, a charge generating layer 6, and a charge transport layer 7. The member shown in FIG. 1 also has an optional overcoating layer 8 and a ground strip 9, the strip 9 being adjacent the charge transport layer at an outer edge of the imaging member. See U.S. Pat. No. 4,664,995, which is incorporated herein by reference. The ground strip 9 is coated adjacent to the charge transport layer so as to provide grounding contact with a grounding device (not shown) during electrophotographic imaging processes.

Photoreceptors are advantageously manufactured by a process of solution coating one or more layers onto a substrate, which process typically includes numerous heating/drying and cooling cycles. A suitable temperature for the heating/drying cycle is about 135° C.

In accordance with the present invention, there is provided a substrate for an electrostatographic imaging member, the substrate having superb thermal, physical, and mechanical properties comprising at least one material selected from the group consisting of polyether ether ketones, polyphenylene sulfide, polysulfones, polyether imides, polyamide imides and specific polyimides (1), (2) and (3) as follow:

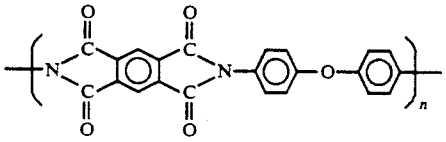

(1)

(2)

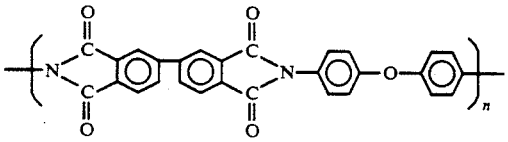

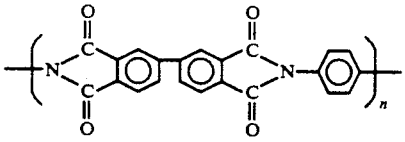

(3)

where n is the degree of polymerization.

Two suitable polyether ether ketone materials are available from ICI Americas, Inc. under the tradenames Stabar K200 and Stabar XK300. These two materials have the formula:

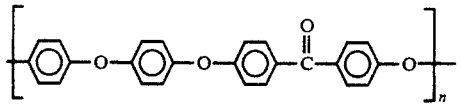

Although substrates made of either material have about equivalent mechanical properties, Stabar XK300 is heat treated to induce crystallinity and improve its Young's modulus. Material (1) is available from E.I. du Pont de Nemours & Co. under the tradename Kapton H, and materials (2) and (3) are available from ICI Americas, Inc. under the tradenames Upilex R and Upilex S, respectively. Kapton H, Upilex R and Upilex S are all polyimides. Nonetheless they are distinctively different from one another not only in their chemical compositions (as shown in the molecular structures above) but also in their thermal and physical/mechanical properties. Properties of materials used to make substrates according to the present invention are listed in Table I below, as are properties for biaxially oriented polyethylene terephthalate (Mylar D), for comparison:

TABLE I

| SUBSTRATE | SUPPLIER | MODULUS (PSI) | $E_S$ (in/in °C.) | Tg (°C.) |
|---|---|---|---|---|
| MYLARD | E. I. du Pont | $4.8 \times 10^5$ | $1.7 \times 10^{-5}$ | 78 |
| STABAR K200 | ICI Americas, Inc. | $4.1 \times 10^5$ | $4.0 \times 10^{-5}$ | 143 |
| STABAR XK300 | ICI Americas, Inc. | $4.8 \times 10^5$ | $4.0 \times 10^{-5}$ | 143 |
| KAPTON H | E. I. du Pont | $4.7 \times 10^5$ | $1.8 \times 10^{-5}$ | 360 |
| UPILEX R | ICI Americas, Inc. | $5.6 \times 10^5$ | $1.5 \times 10^{-5}$ | 285 |
| UPILEX S | ICI Americas, Inc. | $13.1 \times 10^5$ | $1.0 \times 10^{-5}$ | >500 |
| POLYPHENYLENE SULPHIDE | ICI Americas, Inc. | $4.6 \times 10^5$ | $3.0 \times 10^{-5}$ | 92 |

Note: $E_S$ represents the thermal contraction coefficient of the substrate.

Other thermoplastic film-forming resins which have outstanding thermal and physical/mechanical properties and which are suitable for photoreceptor substrate application, such as polyphenylene sulfide, polysulfone, polyether imide, and polyamide imide are included in the scope of the present invention. Representative molecular structures of polyphenylene sulfide, polysulfone, polyether imide, and polyamide imide are presented in (4), (5), (6) and (7), respectively, below:

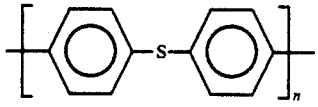

(4)

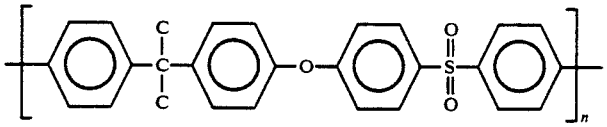

(5)

-continued

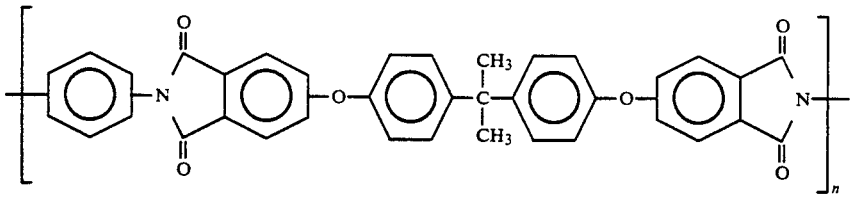

(6)

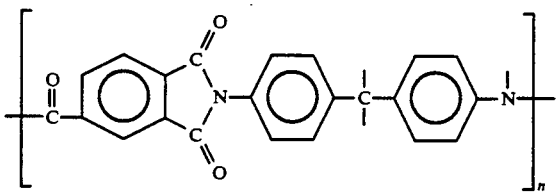

(7)

where n represents the degree of polymerization.

Photoreceptors which are fabricated to include a substrate in accordance with the present invention provide numerous advantages over photoreceptors of the prior art. The total mechanical strain exerted on the photoreceptor is reduced according to the present invention by: (1) reducing thermal contraction mismatches between the charge transport layer and the substrate ($E_1$-$E_s$), thus reducing the build-up of tensile internal strain in the charge transport layer, (2) increasing the Young's modulus (M), thereby reducing the elastic strain ($S_e$), and (3) reducing the thickness of the substrate, which decreases the overall photoreceptor thickness t, thereby reducing the bending strain ($S_b$). In addition, set deformation is reduced, tear propagation resistance is improved, and heat shrinkage at 135° C. processing temperatures is minimized. In some instances, the anti-curl backing layer may be eliminated. Various improvements and combinations of improvements are provided by substrates according to this invention without changing any of the photoelectric layers, maintaining simple photoreceptor design.

Generally, charge transport layers (for photoreceptors), and dielectric layers (for ionographic imaging members), have a thermal contraction coefficient of from $6.0\times10^{-5}$/°C. to $7.0\times10^{-5}$/°C., typically about $6.5\times10^{-5}$/°C. as tested according to ASTM D696-79, "Standard Test Method for Coefficient of Linear Thermal Expansion of Plastics". This, compared to a thermal contraction coefficient of about $1.7\times10^{-5}$ for a substrate formed of Mylar D, represents a thermal contraction mismatch factor of approximately 4 times. A substrate which has a thermal contraction coefficient close to the thermal contraction coefficient of the charge transport layer can help to minimize the internal strain ($S_i$) build-up in the charge transport layer. Polyether ether ketones, e.g., both Stabar K200 and Stabar XK300, having thermal contraction coefficients of $4.0\times10^{-5}$/°C., are particularly suitable for this purpose.

THE SUBSTRATE

The substrate 2 typically constitutes 70% of the total thickness of the photoreceptor. The substrate should be flexible, and may have any number of different configurations such as, for example, a sheet, a scroll, an endless flexible belt, and the like. Preferably, the substrate is in the form of an endless flexible belt.

The thickness of the substrate layer according to this invention is within the range of from about 1 to about 7 mils, preferably about 1.5 to about 4 mils, most preferably about 2 to about 2.5 mils. Minimizing the thickness of the substrate reduces the contribution of bending strain $S_b$.

The selection of a substrate thickness for photoreceptor application is very important. When the substrate thickness is greater than 7 mils, the bending strain $S_b$ of the photoreceptor over a small 19 mm diameter machine belt module roller becomes large and may facilitate charge transport layer cracking. If the substrate is less than 2 mil in thickness, the rigidity and beam strength of the photoreceptor may present a problem and the belt may be very difficult to handle.

The surface of the substrate layer to which a layer is to be applied is preferably cleaned prior to coating to promote greater adhesion for the deposited coating. Cleaning may be effected by exposing the surface of the substrate layer to plasma discharge, ion bombardment and the like.

THE ELECTRICALLY CONDUCTIVE GROUND PLANE

The electrically conductive ground plane 3 may be an electrically conductive metal layer which may be formed, for example, on the substrate 2 by any suitable coating technique, such as a vacuum depositing technique. Suitable metals include aluminum, zirconium, niobium, tantalum, vanadium, hafnium, titanium, nickel, stainless steel, chromium, tungsten, molybdenum, and the like, and mixtures thereof. The thickness of the conductive layer may be within substantially wide ranges, depending on the optical transparency and flexibility desired for the electrophotoconductive member. Accordingly, for a flexible photoresponsive imaging device, the thickness of the conductive layer is preferably between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers are combinations of materials such as conductive indium tin oxide as a transparent layer for light having a wavelength between about 4000 Angstroms and about 9000 Angstroms or a conductive carbon black dispersed in a plastic binder as an opaque conductive layer.

THE HOLE BLOCKING LAYER

After deposition of the electrically conductive ground plane layer, the hole blocking layer 4 may be applied thereto. Electron blocking layers for positively charged photoreceptors allow holes from the imaging surface of the photoreceptor to migrate toward the conductive layer. For negatively-charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen-containing siloxanes or nitrogen-containing titanium compounds such as trimethoxysilyl propyl ethylene diamine, N-beta-(aminoethyl) gamma-amino- propyl trimethoxy silane, isopropyl 4-aminobenzene sulfonyl, di(dodecylbenzene sulfonyl) titanate, isopropyl di(4-aminobenzoyl)isostearoyl titanate, isopropyl di(4-aminobenzoyl)isostearoyl titanate, isopropyl tri(N- ethylaminoethylamino)titanate, isopropyl trianthranil titanate, isopropyl tri(N,N-dimethyl-ethylamino)-titanate, titanium-4-amino benzene sulfonate oxyacetate, titanium 4- aminobenzoate isostearate oxyacetate, $[H_2N(CH_2)_4]CH_3Si(OCH_3)_2$, (gamma-aminobutyl) methyl diethoxysilane, $[H_2N(CH_2)_3]CH_3Si(OCH_3)_2$, and (gamma-aminopropyl) methyl diethoxysilane, as disclosed in U.S. Pat. Nos. 4,338,387, 4,286,033 and 4,291,110. A preferred hole blocking layer comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

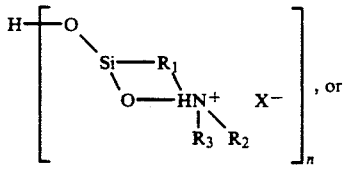

I

, or

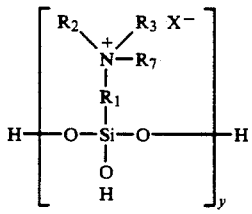

II wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

ADHESIVE LAYER(S)

In most cases, intermediate layers between the blocking layer and the adjacent charge generating or photogenerating layer may be desired to promote adhesion. For example, the adhesive layer 5 may be employed as a single layer or a dual layer consisting of two separate layers of adhesive coatings. If such a layer (or layers) is used, it preferably has a dry thickness between about 0.01 micrometer and about 0.2 micrometer. Typical adhesive layers include film-forming polymers such as polyester, du Pont 49,000 resin (available from E.I. du Pont de Nemours & Co.), Vitel PE-100 (available from Goodyear Rubber & Tire Co.), polyvinylbutyral, polyvinylpyrrolidone, polyurethane, polymethyl methacrylate, and the like.

THE CHARGE GENERATING LAYER

Any suitable charge-generating (photogenerating) layer may be employed, e.g., layer 6 may be applied to the adhesive layer 5. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal-free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradename Monastral Red, Monastral Violet and Monastral Red Y, Vat orange 1 and Vat orange 3 (trade names for dibromo anthanthrone pigments), benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film-forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge-generating layers comprising a photoconductive material such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infra-red light.

Any suitable polymeric film-forming binder material may be employed as the matrix in the photogenerating layer. Typical polymeric film-forming materials include those described, for example, in U.S. Pat. No. 3,121,006. The binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1- trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge-generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge-generating layer binder polymer should dissolve the polymer binder utilized in the charge-generating layer and be capable of dispersing the photogenerating pigment particles present in the charge-generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The thickness of the photogenerating layer is generally in the range of from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected, providing the objectives of the present invention are achieved.

Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

THE CHARGE TRANSPORT LAYER

The charge transport layer 7 may comprise any suitable transparent organic polymer or non-polymeric material capable of supporting the injection of photogenerated holes and electrons from the charge generating layer 6 and allowing the transport of these holes or electrons through the organic layer to selectively discharge the surface charge. The charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It is comprised of a substantially non-photoconductive material which supports the injection of photogenerated holes from the charge generating layer. The charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds dispersed in normally electrically inactive polymeric materials for making these materials electrically active. These compounds may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge transporting aromatic amine compound, and about 75 percent to about 25 percent by weight of a polymeric film-forming resin in which the aromatic amine is soluble.

The charge transport layer is preferably formed from a mixture comprising an aromatic amine compound of one or more compounds having the general formula:

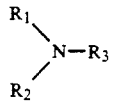

wherein $R_1$ and $R_2$ are the same or different aromatic groups selected from the group consisting of substituted or unsubstituted phenyl groups, naphthyl groups, and polyphenyl groups and $R_3$ is selected from the group consisting of substituted or unsubstituted aryl groups, alkyl groups having from 1 to 18 carbon atoms and cycloaliphatic compounds having from 3 to 18 carbon atoms. The substituents should be free from electron-withdrawing groups such as NO2 groups, CN groups, and the like. Typical aromatic amine compounds that are represented by this structural formula include:

I. Triphenyl amines such as:

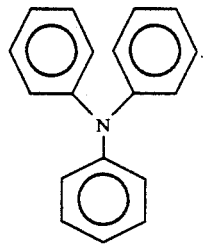

II. Bis and poly triarylamines such as:

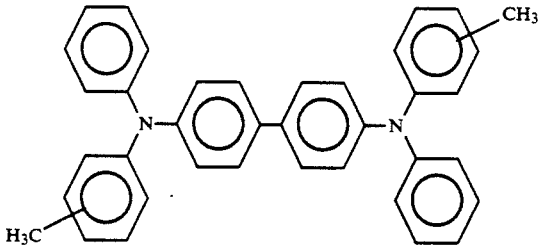

III. Bis arylamine ethers such as:

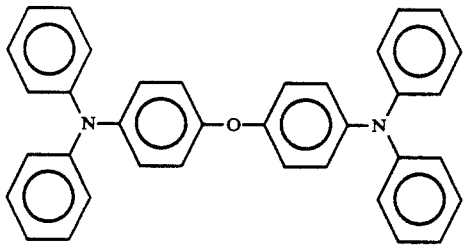

and

IV. Bis alkyl-arylamines such as:

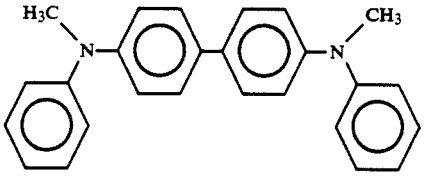

A preferred aromatic amine compound has the general formula:

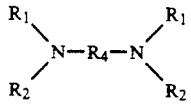

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms.

Examples of charge-transporting aromatic amines represented by the structural formulae above include triphenylmethane, bis(4-diethylamine-2-methylphenyl)-phenylmethane; 4,4'-bis(diethylamino)-2,2'-dimethyltriphenylmethane, N,N'-bis(alkyl-phenyl)-1,1'-biphenyl)-4,4'-diamine wherein the alkyl is, for example, methyl, ethyl, propyl, n-butyl, etc., N,N'-diphenyl-N,N'-bis(3-methylphenyl)-(1,1'biphenyl)-4,4'-diamine, and the like, dispersed in an active resin binder.

Any suitable inactive resin binder soluble in methylene chloride or other suitable solvents may be employed, provided that the material used in the adhesive layer is insensitive to the solvent used. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; Makrolon, a polycarbonate resin having a molecular weight of from about 50,000 to about 120,000, available as Makrolon from Farbenfabricken Bayer A. G.; Merlon, a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

The thickness of the charge transport layer may be in the range of from about 10 micrometers to about 50 micrometers, preferably from about 20 micrometers to about 35 micrometers. Optimum thicknesses are in the range of from about 23 micrometers to about 31 micrometers.

THE GROUND STRIP

The ground strip may comprise a film-forming polymer binder and electrically conductive particles. Cellulose may be used to disperse the conductive particles.

Any suitable electrically conductive particles may be used in the electrically conductive ground strip layer 9 of this invention. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

THE ANTI-CURL LAYER

The anti-curl layer 1 is optional, and may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film-forming resin and an adhesion promoter polyester additive. Examples of film-forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film-forming resin addition. The thickness of the anti-curl layer is from about 3 micrometers to about 35 micrometers, and preferably about 14 micrometers.

THE OVERCOATING LAYER

The optional overcoating layer 8 may comprise organic polymers or inorganic polymers that are electrically insulating or slightly semiconductive. The overcoating layer preferably has a thickness in the range of from about 2 micrometers to about 8 micrometers, and preferably from about 3 micrometers to about 6 micrometers. A preferred range of thickness is from about 3 micrometers to about 5 micrometers.

For electrographic imaging members, a flexible dielectric layer overlying the conductive layer 3 may be used in place of the active photoconductive layers. Any suitable, conventional, flexible, electrically insulating, thermoplastic dielectric polymer matrix material may be used in the dielectric layer of the electrographic imaging member. Suitable such materials are disclosed in U.S. Pat. No. 4,983,481, which is incorporated herein in its entirety. If desired, the flexible belts of this invention may be used for other purposes where cycling durability is important.

The invention will further be illustrated in the following, non-limiting examples, it being understood that these examples are intended to be illustrative only and that the invention is not intended to be limited to the materials, conditions, process parameters and the like recited therein.

EXAMPLE 1

3 mil substrates of Mylar D (available from E.I. du Pont), Stabar K200 and Stabar XK30 (both available from ICI Americas, Inc.), and Upilex R and Upilex S (both available from ICI Americas, Inc.) are evaluated for modulus, heat shrinkage, permanent set, and susceptibility to tear propagation. Since about 70 percent of a fabricated multilayered photoreceptor typically consists of a substrate which serves as the mechanical and/or support for all the coating layers, the determination of the thermal and physical/mechanical properties of these substrates is crucially important because it will have a direct effect on the mechanical integrity and performance of the resulting photoreceptor design. Since Mylar D is the most common substrate preferred for both flexible electrophotographic imaging member and flexible ionographic imaging member applications in the prior art, the results obtained for these testings can serve as a control for direct comparison with the results of the substrate of the present invention.

The Young's Modulus of a substrate is a proportional constant that relates the elastic deformation of the substrate in response to an externally imposed stress. Since high Young's Modulus reflects high substrate rigidity, it also reflects the relative ease of handing of a photoreceptor belt. The Young's Modulus also reflects the extent of instantaneous belt elongation upon subjection to an applied machine belt tension; therefore, it impacts the creep behavior of the photoreceptor belt. The measurement of the Modulus of the substrates was carried out with the following testing procedure:

a) Cut five substrate test samples each having dimensions of 0.5 in.×4 in. (1.27×10.16 cm) from each type of the substrates.
b) Insert the test sample into Instron jaws with 2 in. (5.1 cm) gage length.
c) Using a 0.02 in/min (0.051 cm/min) crosshead speed, 20 in/min (50.8 cm/min) chart speed, and 1 lb (0.454 kg) full scale, pull the sample to full scale load.
d) Draw the best straight line over the force-elongation curve on the chart to represent the slope.
e) Calculate the Young's Modulus as follows, $$E = \text{stress/strain}$$

where stress = 1 lb/sample cross-section area, in$^2$.

$$\text{Strain} = \frac{\text{change in sample length at 1 lb. load, in.}}{\text{2 in.}}$$

A substrate heat shrinkage test is carried out by cutting 1 in.×12 in. (2.54×30.5 cm) test samples from the substrates for heat exposure. The linear dimensional change in the samples is measured before and after storage at 135° C. for 30 minutes in an air circulating oven using a cathetometer. The results obtained are calculated to give the decrease in sample length after heat exposure with respect to its original and expressed in percentage of dimensional contraction. Since a typical multilayered photoreceptor design, shown in FIG. 1, consists of six layers of sequential applied solution coatings and each dried at 135° C. for 5 minutes, this substrate heat shrinkage testing condition is selected to imitate the cumulative effect of time/temperature cycles on dimensional stability of the actual photoreceptor fabrication process.

Permanent set is evaluated by bending or parking 1 in.×8 in. (2.54×20.3 cm) substrate test samples over a small 19 mm diameter roller. A 0.5 pound weight is hung at each sample end to simulate the effect of the applied photoreceptor belt tension in a machine on the supporting substrate. The testing set-up is then kept under a control temperature of 48° C. for 72 hours to duplicate the mid-summer weekend machine shut off photoreceptor belt idling conditions. The effect of sample conformance to the roller is determined by measuring the arc formation at the segment of the test sample caused by sample/roller bending contact after releasing the applied tension and sample rebound, and expressed the results in terms of diameter of curvature to represent the extend of substrate set.

The susceptibility of a substrate to tear propagation is experimentally determined by following the procedures of Trouser-tear test method described in the literature: Richard L. Webber and Gunnar, "The Determination of Tear Energy of Extensible Materials of Dental Interest", *J. Biomed. Mater. Res.*, vol. 2, pp. 281–296, 1968.

The testing results obtained for modulus, heat shrinkage, set and tear propagation are collectively tabulated in Table II below. The values for thermal contraction coefficient $E_S$ and glass transition temperature Tg of these substrates, though not measured, are supplied by the manufacturers and are listed in the last two columns of the table.

TABLE II

| Type of Substrate | Manufacturer | Modulus (PSI) | Ht. Shrink. (%) | Set* (mm) | Tear Prop. (gm/mil) | $E_S$ (in/in °C.) | Tg (°C.) |
|---|---|---|---|---|---|---|---|
| Mylar D | E. I. du Pont | $4.8 \times 10^5$ | 0.85 | 41 | 16 | $1.7 \times 10^{-5}$ | 78 |
| Stabar K200 | ICI Americas, Inc. | $4.1 \times 10^5$ | 0.02 | 146 | 50 | $4.0 \times 10^{-5}$ | 143 |
| Stabar XK300 | ICI Americas, Inc. | $4.8 \times 10^5$ | 0.02 | 146 | 44 | $4.0 \times 10^{-5}$ | 143 |
| Kapton H | E. I. du Pont | $4.8 \times 10^5$ | 0.03 | 54 | 25 | $1.8 \times 10^{-5}$ | 360 |
| Upilex R | ICI Americas, Inc. | $5.6 \times 10^5$ | 0.02 | 64 | 31 | $1.5 \times 10^{-5}$ | 285 |
| Upilex S | ICI Americas, Inc. | $13.1 \times 10^5$ | 0.02 | 70 | 23 | $1.1 \times 10^{-5}$ | >500 |

*Set is represented as the extent of conformance in diameter of curvature measured for each substrate after static-bend testing. If a substrate has no set and exhibits a perfect flat configuration, its diameter of curvature is, therefore, infinity.

The above data indicate that all the substrates of the present invention possess inherent thermal and physical/mechanical properties which are superior to values obtained for the Mylar D control counterpart. When adapted for electrophotographic imaging member and ionographic imaging member implementation, they should provide the resulting members with extended mechanical service life.

EXAMPLE II

Three photoconductive imaging members are prepared by providing a titanium coated biaxially oriented polyethylene terephthalate (Mylar D available from E.I. du Pont) substrate having thicknesses of 1, 2 and 3 mils, and applying thereto, using a gravure applicator, a solution containing 50 grams 3-amino-propyltriethoxysilane, 15 grams acetic acid, 684.8 grams of 200 proof denatured alcohol and 200 grams heptane. This layer is then dried for 10 minutes at 135° C. in a forced air oven. The resulting blocking layer has a dry thickness of 0.05 micrometer.

An adhesive interface layer is then prepared by applying a wet coating over the blocking layer, using a gravure applicator, containing 0.5 percent by weight based on the total weight of the solution of polyester adhesive (du Pont 49,000, available from E.I. du Pont de Nemours & Co.) in a 70:30 volume ratio mixture of tetrahydrofuran/cyclohexanone. The adhesive interface layer is then dried for 10 minutes at 135° C. in a forced air oven. The resulting adhesive interface layer has a dry thickness of 0.05 micrometer.

The adhesive interface layer is thereafter coated with a photogenerating layer containing 7.5 percent by volume trigonal selenium, 25 percent by volume N,N'-diphenyl-N,N'-bis(3-methyl-phenyl)-1,1'-biphenyl-4,4'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is then placed on a shaker for 10 minutes. The resulting slurry is thereafter applied to the adhesive interface with an extrusion die to form a layer having a wet thickness of about 0.5 mil. However, a strip about 3 mm wide along one edge of the substrate, blocking layer and adhesive layer is deliberately left uncoated by any of the photogenerating layer material to facilitate adequate electrical contact by the ground strip layer that is applied later. This photogenerating layer is dried at 135° C. for 5 minutes in a forced air oven to form a photogenerating layer having a dry thickness of 2.3 micrometers.

This member is then coated over with a charge transport layer. The charge transport coating solution is prepared by introducing into an amber glass bottle in a weight ratio of 1:1 N,N'-diphenyl-N,N'-bis(3-methylphenyl)-1,1'-biphenyl-4,4'-diamine, and the binder resin Makrolon 5705, a polycarbonate having a weight average molecular weight from about 50,000 to about 1,000,000, available from Farbenfabricken Bayer AG. The resulting mixture is dissolved in methylene chloride to provide a 15 weight percent solution thereof. This solution is then applied onto the photogenerator layer with a 3 mil gap Bird applicator to form a wet charge transport layer. During this coating process the relative humidity is maintained at about 14 percent. The resulting photoconductive member is then annealed at 135° C. in a forced air oven for 5 minutes to produce a 24 micrometers dry thickness charge transport layer.

After application of the charge transport layer coating, if the imaging member spontaneously curls upwardly, an anti-curl coating can be applied to impart the desired flatness to the imaging member. The anti-curl coating solution is prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle is then covered tightly and placed on a roll mill for about 24 hours until total dissolution of the polycarbonate and the copolyester is achieved. The anti-curl coating solution thus obtained is applied to the rear surface of the supporting substrate (the side opposite to the imaging layers) by hand coating using a 3 mil gap Bird applicator. The coated wet film is dried at 135° C. in an air circulation oven for about 5 minutes to produce a dry, 14 micrometer thick anti-curl layer. The resulting photoconductive imaging member is flat.

EXAMPLE III

The photoconductive imaging members having 1, 2 and 3 mil Mylar D substrates of Example II are cut to form 2.54 cm×30.5 cm (1 inch by 12 inches) samples and are tested for dynamic fatigue charge transport layer cracking resistance. Testing is effected by means of a dynamic mechanical cycling device in which each imaging sample is flexed over idler rolls to simulate photoconductive imaging member belt machine conditions. More specifically, one end of an imaging test sample is clamped to a stationary post and the sample is looped upwardly over three equally spaced horizontal idler rolls and then downwardly to form a generally inverted "U" shaped path with the free end of the sample attached to a 1 pound weight to provide a one pound per inch sample width tension. The face of the test sample bearing the charge transport layer faces upwardly such that it is subjected to the maximum induced bending stress as the sample is flexed over the idler rolls. Each idler roll has a diameter of 19 mm (¾ inch) and is attached at each end to an adjacent vertical surface of a pair of disks that are rotatable, by means of an electric motor, about a shaft connecting the centers of the disks. The three idler rolls are parallel to and equidistant from each other. The idler rolls are also equidistant from the shaft connecting the centers of the disk.

Although the disks are rotated about the shaft, each idler roll is secured to the disks and freely rotates around each individual roll axis. Thus, as the disks rotate about the shaft, two idler rolls are maintained at all times in contact with the back surface of the test sample. The axis of each idler roll is positioned about 4 cm from the shaft. The direction of movement of the idler rolls along the back surface of the test sample is away from the weighted end of the test sample and toward the end that is clamped to the stationary post. since there are three idler rolls in the test device, each complete rotation of the disks is equivalent to three bending flexes. The rotation of the spinning disks is adjusted to provide the equivalent of 28.7 cm (11.3 inches) per second tangent speed. The appearance of dynamic fatigue cracking of the charge transport layer is examined at intervals of 5,000 flexes using a reflection optical microscope at 100× magnification.

The results of dynamic fatigue charge transport layer cracking listed in Table III below show that the cracking resistance of the charge transport layer is gradually improved as the thickness of the substrate used for the photoconductive imaging member is reduced. An over 2 times cracking life improvement is noted when the Mylar D substrate support in the imaging member is decreased from 3 to 2 mils in thickness. In addition to the dynamic fatigue cracking test, the photoconductive imaging member's bending strain $S_b$ over the 19 mm roller is theoretically calculated using equation (3). Theoretical values listed in the last column of the table support the dynamic fatigue cracking data. It should be emphasized that decreasing the bending strain by reducing the substrate thickness in the imaging member should also decrease set.

TABLE III

| Mylar D Thickness (mils) | Fatigue Cracking (Flexes) | Bending Strain (%) |
|---|---|---|
| 3 | 170,000 | 0.598 |
| 2½ | 235,000 | 0.534 |
| 2 | 355,000 | 0.470 |

EXAMPLE IV

A photoconductive imaging member is prepared by following the same procedures and using the same materials as described in Example II, with the exception that the Mylar D substrate is replaced by a 3 mil thick polyether ether ketone substrate which has a tradename Stabar K200 and is available from ICI Americas, Inc.

EXAMPLE V

A photoconductive imaging member is prepared by following the same procedures and using the same materials as described in Example II, with the exception that the Mylar D substrate is replaced by a 3 mil thick polyether ether ketone substrate which has a tradename Stabar XK300 and is available from ICI Americas, Inc.

EXAMPLE VI

A photoconductive imaging member is prepared by following the same procedures and using the same materials as described in Example II, with the exception that the Mylar D substrate is replaced by a 3 mil thick biaxially oriented polyimide substrate which has a tradename Kapton H and is available from E.I. du Pont de Nemours & Co.

EXAMPLE VII

A photoconductive imaging member is prepared by following the same procedures and using the same materials as described in Example II, with the exception that the Mylar D substrate is replaced by a 3 mil thick biaxially oriented polyimide substrate which has a tradename Upliex R and is available from ICI Americas, Inc.

EXAMPLE VIII

A photoconductive imaging member is prepared by following the same procedures and using the same materials as described in Example II, with the exception that the Mylar D substrate is replaced by a 3 mil thick biaxially oriented polyimide substrate which has a tradename Upilex S and is available from ICI Americas, Inc.

EXAMPLE IX

The photoconductive imaging members of Examples IV to VIII are evaluated for modulus, set and tear propagation by following the test procedures detailed in Example 1. The dynamic fatigue charge transport layer cracking of these photoconductive imaging member is also evaluated by employing the mechanical fatigue cyclic test method described in Example III. For comparison purposes, the photoconductive imaging member fabricated using a 3 mil Mylar D substrate of Example II is evaluated to serve as a control. The thermal and mechanical test results are listed in the following Table IV:

TABLE IV

| Example | Modulus (PSI) | Set (mm) | Tear Prop. (gms/mil) | Fatigue Cracking (flexes) |
|---|---|---|---|---|
| II Control | $4.5 \times 10^5$ | 29 | 14 | 170,000 |
| IV | $4.3 \times 10^5$ | 138 | 48 | 200,000 |
| V | $4.8 \times 10^5$ | 135 | 43 | 210,000 |
| VI | $4.9 \times 10^5$ | 43 | 21 | 190,000 |
| VII | $5.4 \times 10^5$ | 51 | 30 | 215,000 |
| VIII | $10.1 \times 10^5$ | 59 | 24 | 230,000 |

The data in this table indicate that the photoconductive imaging members of Examples IV to VIII, fabricated using the substrates of the present invention, give generally better modulus, less or minimum set, and improved resistance to tear propagation relative to the control imaging member of Example II. Furthermore, these photoconductive imaging members provide substantial extension of the fatigue cracking life of the charge transport layer; the observed charge transport layer cracking resistance enhancement is contributed by: (1) increasing the modulus, in accordance with Equation 2, which decreases the elastic strain $S_e$ of the imaging member in response to the applied tension; and (2) increasing the resistance to set, which decreases the amount of imaging member creep (a constant elongation due to viscous molecular flow when under applied stress) at extended dynamic fatigue testing.

EXAMPLE X

The electrical properties of the photoconductive imaging members prepared according to Examples II and IV through VIII are tested at 21° C. and 40 percent relative humidity, using a xerographic scanner. The 50,000 cycles of testing give identical charge acceptance, dark decay rate, background and residual voltages, photoinduced discharge characteristics, and cycle-down for all photoconductive imaging members. These identical results are achieved due to the fact that the photoconductive imaging members only undergo substrate replacement without changing any of the electrical operative layer, nor altering their fabrication and processing method. The photoconductive imaging members prepared using the substrates of this invention provide overall mechanical characteristic improvement as well as maintaining the photo-electrical integrity.

While the invention has been described with reference to particular preferred embodiments, the invention is not limited to the specific examples given, and other embodiments and modifications can be made by those skilled in the art without departing from the spirit and scope of the invention.

What is claimed is:

1. An electrostatographic imaging member having a supporting non-conductive substrate comprising at least one material selected from the group consisting of polyether ether ketones, polysulfones, and polyether imides.

2. An electrostatographic imaging member as recited in claim 1, wherein said substrate has a thickness in the range of from about 1.0 to about 7.0 mils.

3. An electrostatographic imaging member as recited in claim 1, wherein said substrate has a thickness in the range of from about 1.5 to about 4.0 mils.

4. An electrostatographic imaging member as recited in claim 1, wherein said substrate has a thickness in the range of from about 2.0 to about 2.5 mils.

5. An electrostatographic imaging member as recited in claim 1, wherein said imaging member is electrophotographic.

6. An electrostatographic imaging member as recited in claim 1, wherein said imaging member is a belt.

7. A non-conductive substrate for an electrostatographic imaging member comprising at least one material selected from the group consisting of polyether ether ketones, polysulfones, and polyether imides.

8. A substrate as recited in claim 7, wherein said substrate has a thickness in the range of from about 1.0 to about 7.0 mils.

9. A substrate as recited in claim 7, wherein said substrate has a thickness in the range of from about 1.5 to about 4.0 mils.

10. A substrate as recited in claim 7, wherein said substrate has a thickness in the range of from about 2.0 to about 2.5 mils.

11. A method of making an electrostatographic imaging member, comprising applying at least one layer to a non-conductive substrate, the substrate comprising at least one material selected from the group consisting of polyether ether ketones, polysulfones, and polyether imides.

12. A method as recited in claim 11, wherein said imaging member is electrophotographic.

13. A method as recited in claim 11, wherein said imaging member is electrographic.

14. A method as recited in claim 11, wherein said imaging member is a belt.

15. An electrostatographic imaging member as recited in claim 1, wherein said substrate comprises at least one polyether ether ketone.

16. A substrate as recited in claim 7, wherein said substrate comprises at least one polyether ether ketone.

17. A method as recited in claim 11, wherein said substrate comprises at least one polyether ether ketone.

18. An electrostatographic imaging member having a supporting substrate consisting essentially of at least one material selected from the group consisting of polyether ether ketones, polysulfones, and polyether imides.

19. A substrate for an electrostatographic imaging member, said substrate consisting essentially of at least one material selected from the group consisting of polyether ether ketones, polysulfones, and polyether imides.

20. A method of making an electrostatographic imaging member, comprising applying at least one layer to a substrate, the substrate consisting essentially of at least one material selected from the group consisting of polyether ether ketones, polysulfones, and polyether imides.

21. An electrostatographic imaging member having a supporting substrate comprising at least one material selected from the group consisting of polyphenylene sulfides, polyamide imides and compounds (1), (2) and (3) as follows:

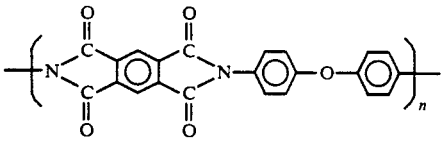

(1)

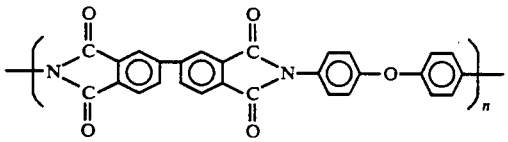

(2)

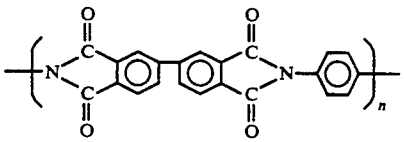

(3)

n representing the degree of polymerization.

22. An electrostatographic imaging member as recited in claim 21, wherein said substrate has a thickness in the range of from about 1.0 to about 7.0 mils.

23. An electrostatic imaging member as recited in claim 22, wherein said substrate has a thickness in the range of from about 1.5 to about 4.0 mils.

24. An electrostatographic imaging member as recited in claim 23, wherein said substrate has a thickness in the range of from about 2.0 to about 2.5 mils.

25. An electrostatographic imaging member as recited in claim 21, wherein said imaging member is electrophotographic.

26. A method as recited in claim 21, wherein said imaging member is electrographic.

27. An electrostatographic imaging member as recited in claim 21, wherein said imaging member is a belt.

28. A supporting substrate for an electrostatographic imaging member comprising at least one material selected from the group consisting of polyphenylene sulfides, polyamide imides and compounds (1), (2) and (3) as follow:

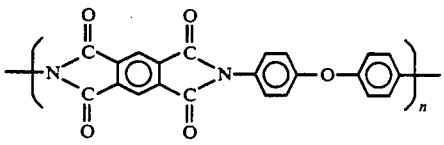

(1)

-continued

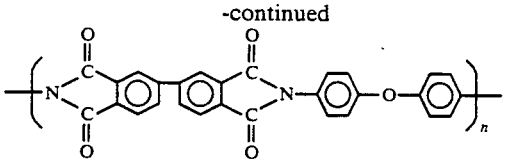

(2)

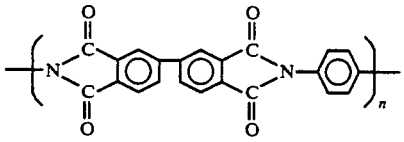

(3)

n representing the degree of polymerization.

29. A substrate as recited in claim 28, wherein said substrate has a thickness in the range of from about 1.0 to about 7.0 mils.

30. A substrate as recited in claim 29, wherein said substrate has a thickness in the range of from about 1.5 to about 4.0 mils.

31. A substrate as recited in claim 30, wherein said substrate has a thickness in the range of from about 2.0 to about 2.5 mils.

32. A method of making an electrostatographic imaging member, comprising applying at least one layer to a substrate, the substrate comprising at least one material selected from the group consisting of polyphenylene sulfides, polyamide imides and compounds (1), (2) and (3) as follows:

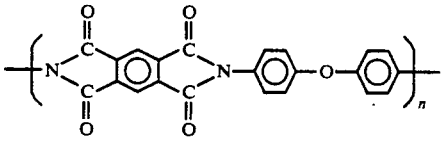

(1)

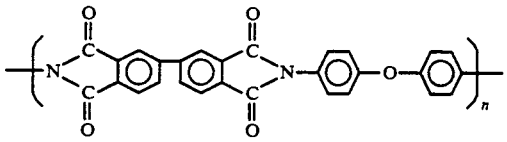

(2)

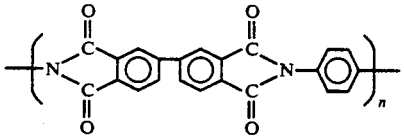

(3)

n representing the degree of polymerization.

33. A method as recited in claim 32, wherein said imaging member is electrophotographic.

34. A method as recited in claim 32, wherein said imaging member is electrographic.

35. A method as recited in claim 32, wherein said imaging member is a belt.

* * * * *